US007900402B2

(12) United States Patent
Staten et al.

(10) Patent No.: US 7,900,402 B2
(45) Date of Patent: Mar. 8, 2011

(54) POWERED DUAL LEVEL TELESCOPIC SEATING RISER ASSEMBLY

(75) Inventors: Kenneth Edward Staten, Clare, MI (US); Orley David Rogers, Sanford, MI (US)

(73) Assignee: Stageright Corporation, Clare, MI (US)

( * ) Notice: Subject to any disclaimer, the term of this patent is extended or adjusted under 35 U.S.C. 154(b) by 1018 days.

(21) Appl. No.: 11/542,753

(22) Filed: Oct. 4, 2006

(65) Prior Publication Data

US 2008/0083170 A1 Apr. 10, 2008

(51) Int. Cl.
*E04H 3/12* (2006.01)

(52) U.S. Cl. ..... 52/10; 52/6; 52/8; 52/9

(58) Field of Classification Search ..... 52/6, 8, 52/9, 10; 472/59, 60, 130; 434/29, 55
See application file for complete search history.

(56) References Cited

U.S. PATENT DOCUMENTS 2,898,639 A * 8/1959 Murphy ..... 52/10
2,968,842 A * 1/1961 Murphy ..... 52/10
2,990,587 A * 7/1961 Murphy ..... 52/10
3,069,732 A * 12/1962 Murphy ..... 52/10
3,107,398 A * 10/1963 Murphy ..... 52/10
3,213,570 A * 10/1965 Abramson, Jr. ..... 52/8
3,488,898 A * 1/1970 Scaggs ..... 52/10
3,748,798 A * 7/1973 Mackintosh ..... 52/10
4,000,586 A * 1/1977 Vance et al. ..... 52/9
4,285,172 A * 8/1981 Quigley ..... 52/10
4,979,340 A * 12/1990 Wilson et al. ..... 52/9
5,069,007 A * 12/1991 Paddock ..... 52/9
5,205,087 A * 4/1993 Jines ..... 52/6
5,381,873 A 1/1995 Kniefel et al.
5,467,840 A * 11/1995 Becher et al. ..... 180/251
5,559,411 A * 9/1996 Winship ..... 318/466
5,673,518 A * 10/1997 Paddock ..... 52/9
5,692,445 A 12/1997 Winer
5,796,052 A * 8/1998 Christmann ..... 177/145
5,913,776 A * 6/1999 Compagnone ..... 52/10
6,029,406 A * 2/2000 Staehlin ..... 52/9
6,050,366 A * 4/2000 Lyons ..... 187/200
6,085,861 A 7/2000 Jines
D432,669 S 10/2000 Bryjak et al.
6,199,325 B1 * 3/2001 Winship ..... 52/10
6,324,790 B1 * 12/2001 Victor et al. ..... 52/9
6,539,672 B1 * 4/2003 Frost ..... 52/9
6,571,915 B1 6/2003 de la Tour
6,598,351 B2 * 7/2003 Hallberg ..... 52/9
6,615,548 B1 * 9/2003 Nakamura et al. ..... 52/6
6,719,094 B2 4/2004 de la Tour
6,729,075 B2 * 5/2004 Jines et al. ..... 52/7

(Continued)

*Primary Examiner* — Brian E Glessner
*Assistant Examiner* — Joshua Ihezie
(74) *Attorney, Agent, or Firm* — Carlson Gaskey & Olds PC

(57) ABSTRACT

A telescopic seating system generally includes an innermost lower riser assembly and successive outer elevated riser assemblies. Each elevated riser assembly includes a dual deck surface and a telescopic leg assembly. Each elevated riser assembly supports a toothed belt drive system which provides the interface between each adjacent elevated riser assembly and the motive force to extend and retract the riser system. In operation, electric motors of the toothed belt drive system on each elevated riser assembly are driven by a controller to extend and retract the telescopic seating system between a fully extended position, a half-deployed position and a storage position. The half-deployed position utilizes the dual deck surface to provide half the seating capacity of each riser at twice the rise between each seating row to thereby accommodate particular venues.

18 Claims, 14 Drawing Sheets

U.S. PATENT DOCUMENTS 6,922,947 B2 8/2005 Jines et al.
7,107,734 B2 9/2006 Jines et al.
2003/0009950 A1* 1/2003 Hallberg ..... 52/8
2003/0038065 A1* 2/2003 Pippin et al. ..... 209/584

* cited by examiner

POWERED DUAL LEVEL TELESCOPIC SEATING RISER ASSEMBLY

BACKGROUND OF THE INVENTION

The present invention relates to portable seating systems and more particularly to a powered telescopic seating riser assembly for a seating system with a multiple of seating configurations drivable between at least an extended position, a half-deployed position, and a stored position.

Seating risers are designed for use in auditoriums, gymnasiums, and event halls to accommodate spectators on portable seats, such as folding chairs. Depending on the intended use, a facility may require seating risers that are capable of being moved from a retracted position for storage, to an extended position for use.

Heretofore, many conventional seating riser structures have been utilized for nonpermanent seating. These conventional systems generally utilize a series of assemblies having seating risers of given heights which store within close proximity to one another.

Because of the temporary nature of the seating used by some organizations and the large storage area required to house non-permanent seating systems when not extended for use, it is desirable to provide a variety of seating configurations with a single non-permanent seating system. With conventional non-permanent seating systems, several assemblies are placed adjacent one another, for instance, to form the seating along an athletic playing surface. Although modular in this sense, conventional non-permanent seating systems have a rise always constant with respect to the run.

Some conventional non-permanent seating systems are manually deployed. Although effective, significant manpower and time is typically required to deploy and store the system. Manual deployment and storage may be further complicated by the requirement that the non-permanent seating system needs to be deployed in a generally coordinated manner, otherwise, binding or other complications may result. Since the non-permanent seating system by its vary nature is a relatively large structure, coordination during manual deployment and storage coordination may be relatively difficult.

Other conventional non-permanent seating systems drive a wheel system thereof. Such drives require friction with a floor surface such that non-uniform traction may also result in the aforementioned binding.

Accordingly, it is desirable to provide a non-permanent seating system that can be readily deployed and stored by a minimal number of unskilled persons, provide a multiple of seating configurations, yet will readily achieve a space efficient storage configuration.

SUMMARY OF THE INVENTION

The non-permanent seating system according to the present invention generally includes an innermost lower riser assembly and successive outer elevated riser assemblies. Each riser assembly includes a dual deck surface and a telescopic leg assembly. Each telescopic leg assembly supports a toothed belt drive system which provides an interface between each adjacent riser assembly and the motive force to extend and retract the non-permanent seating system in a telescopic manner.

The dual deck surface includes a lower deck panel and an upper deck panel to provide a dual level seating surface. The dual deck surface generally includes a deck panel manufactured of an upper and lower deck skin which sandwiches a core formed of an end-grained balsawood to provide a strong, lightweight and acoustically absorbent deck.

Longitudinal access track beams are arranged in a vertical relationship between each deck panel to provide space for folded chairs when in the stored position. The access track beams also provide communication passages for aisle lighting, as well as for the attachment of rails, stair blocks and a chair beam mounting system.

In operation, the electric motor of the toothed belt drive system on each riser assembly are driven by a controller to extend and retract the non-permanent seating system. A controller communicates with the electric motors to provide programmed stops of each riser assembly such that the telescopic seating system may be readily deployed to the fully extended position or a half-deployed position which utilizes only half the seating capacity of each riser assembly but provides twice the rise between each seating row to thereby accommodate particular venues.

The present invention therefore provides a non-permanent seating system that can be readily deployed and stored by a minimal number of unskilled persons, provide a multiple of seating configurations, yet will readily achieve a space efficient storage configuration.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
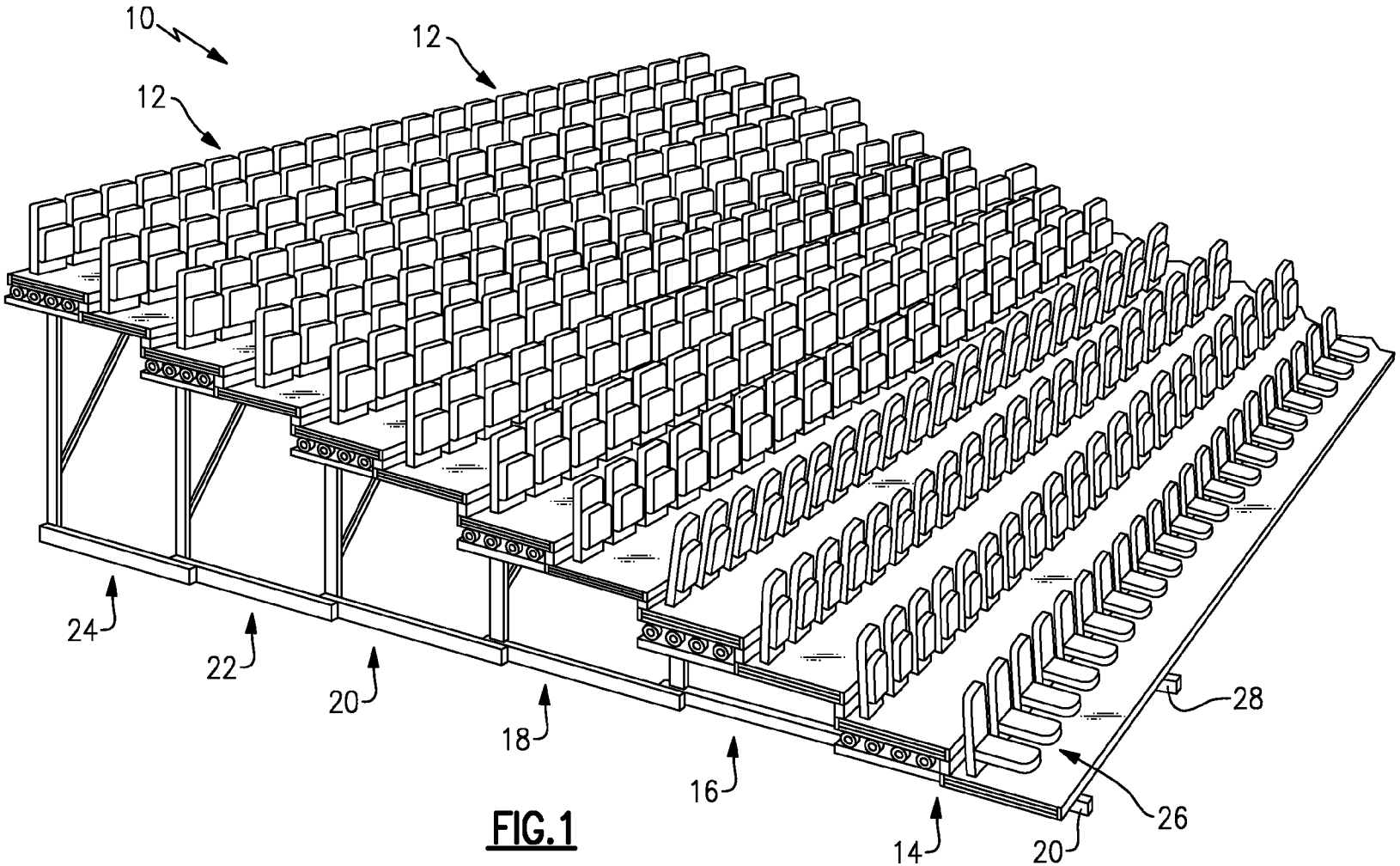
FIG. 1 is a perspective view of a non-permanent seating system in a deployed position.

FIG. 1 illustrates a general perspective view of a non-permanent seating system 10 having a multiple of telescopic seating riser systems 12. The telescoping seating riser system 12 forms the fundamental building blocks of the system 10. The system 12 may stand alone, or may stand side by side. It will be appreciated that the height thereof is dependent on design choices including the desired rise.

Each telescopic seating riser system 12 generally includes an innermost lower riser assembly 14, and successive outer elevated riser assemblies 16-24. It will be appreciated that the number of riser assemblies 14-24 in any given telescopic seating riser system 12 will be a matter of design requirements. Each riser assembly 14-24 generally includes a dual deck surface 26 and a pair of telescopic leg assemblies 28.

Figure 2A:
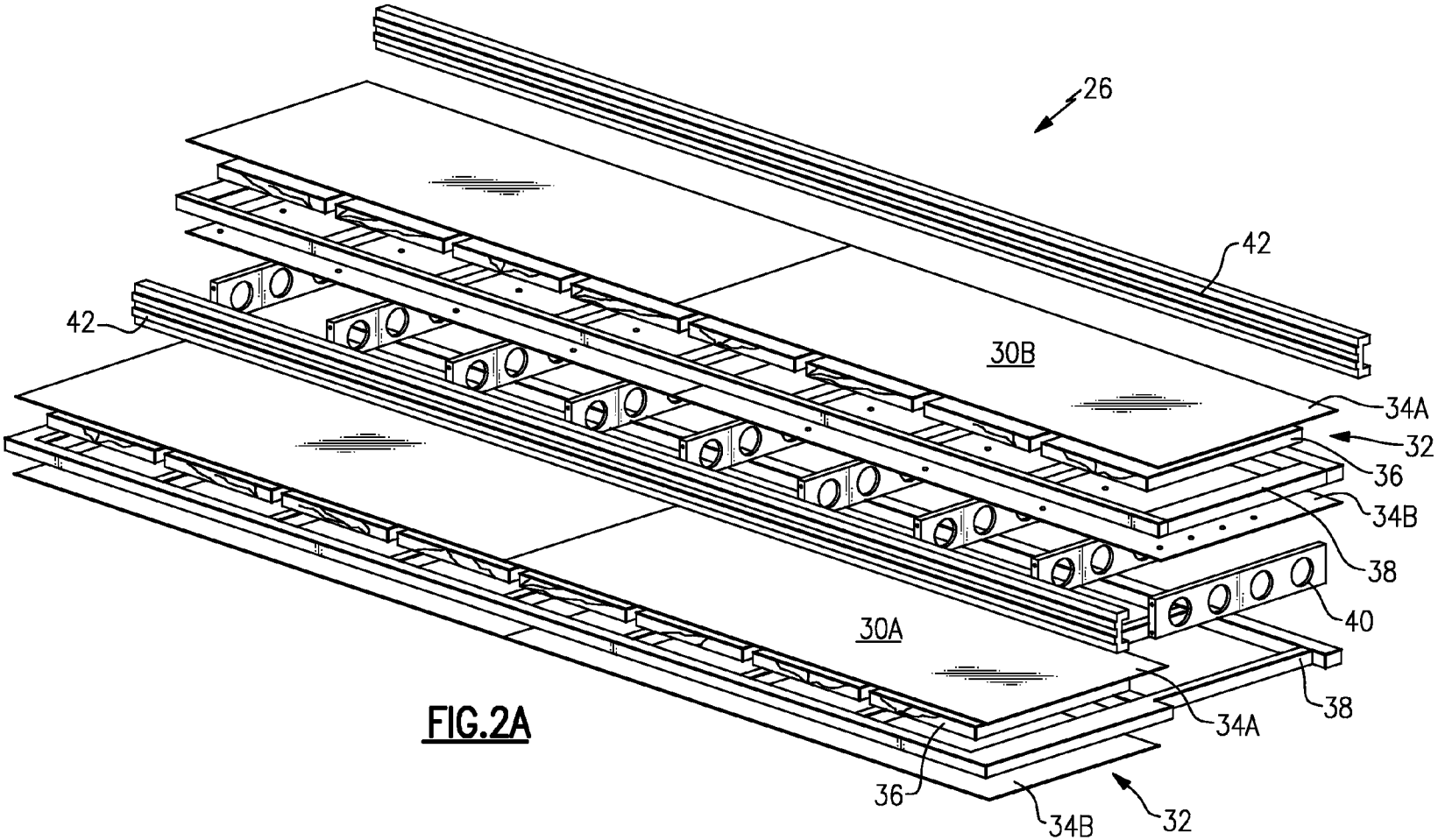
FIG. 2A is an exploded view of a dual deck surface.
Figure 2B:
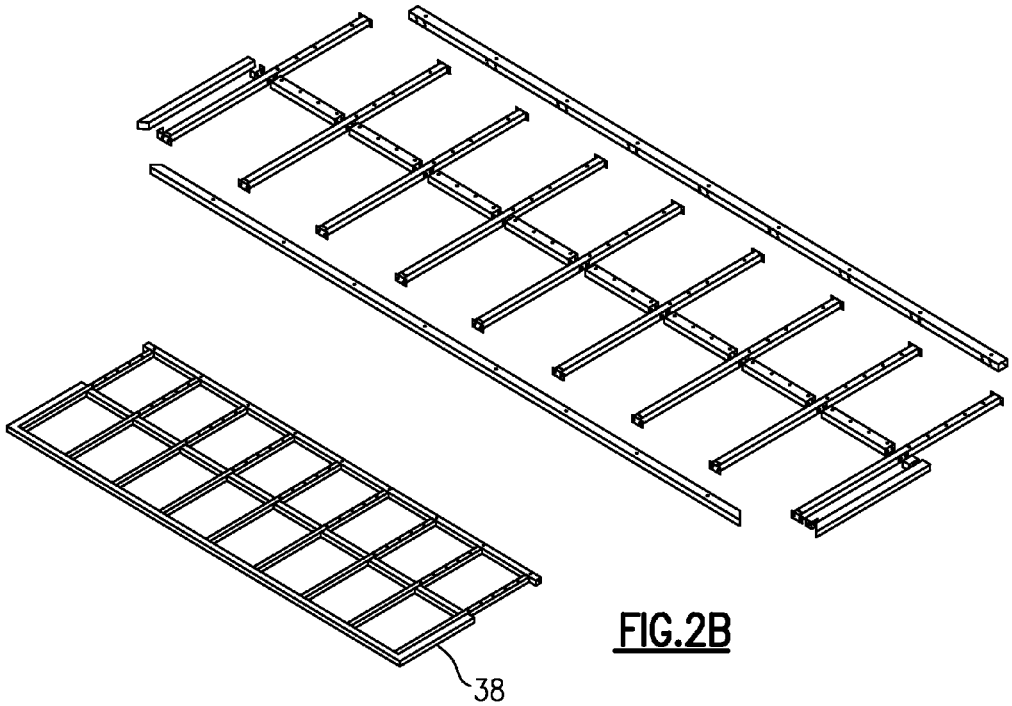
FIG. 2B is a perspective view of a frame of the dual deck surface of FIG. 2A.

Referring to FIG. 2A, the dual deck surface 26 includes a lower deck surface 30A and an upper deck surface 30B arranged in a stepped arrangement. The lower deck surface 30A and the upper deck surface 30B each establish a respective deck plane. The dual deck surface 26 generally utilizes a sandwich structure for each deck panel 32. The deck panel 32 is manufactured of an upper and lower deck skin 34A, 34B which sandwiches a core 36. The skins 34A, 34B are preferably manufactured of aluminum while the core 36 is formed of an end grained balsawood or a honeycomb structure to provide a strong, lightweight and acoustically absorbent structure. The deck panels 32 are mounted to a framework 38 (FIG. 2B) which support a multiple of ribs 40 between a set of longitudinal access track beams 42 (also illustrated in FIG. 2C).

The multiple of ribs 40 provide the dual deck surface 26 by vertically separating the lower deck panel 32L from the upper deck panels 32U. Each riser assembly 14-24 includes one dual deck surface 26 with one lower deck panel 32L and one upper deck panel 32U to provide seating on two levels.

Figure 2C:
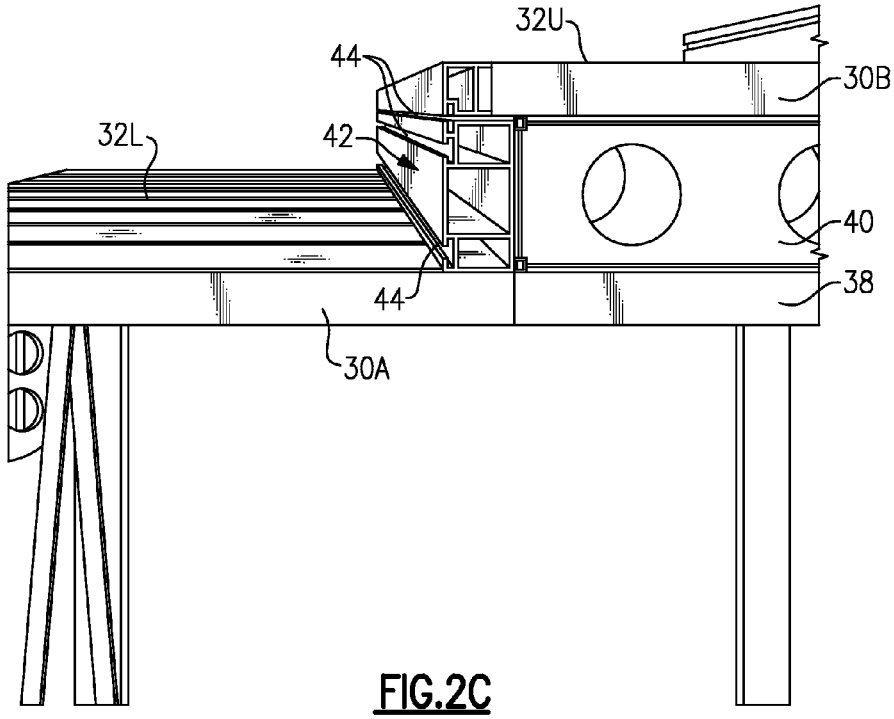
FIG. 2C is a sectional view through the dual deck surface illustrating an access track beam.

Referring to FIG. 2C, the longitudinal access track beams 42 include slots 44 which receive a chair beam mounting system S (FIG. 2D) such as that utilized in stadium seating systems such as that manufactured by Camatic Pty Ltd. of Wantirna, Australia. The access track beams 42 are arranged in a vertical relationship between each deck panel 32L, 32U to provide space for the seating system 10 when in a stored position. The slots 44 are longitudinally located within the access track beams 42 to provide communication passages for, for example only, aisle lighting, and attachment of, for example only, rails R (FIG. 2F), stair blocks B (FIG. 2F) and the aforementioned chair beam mounting system S.

Figure 3A:
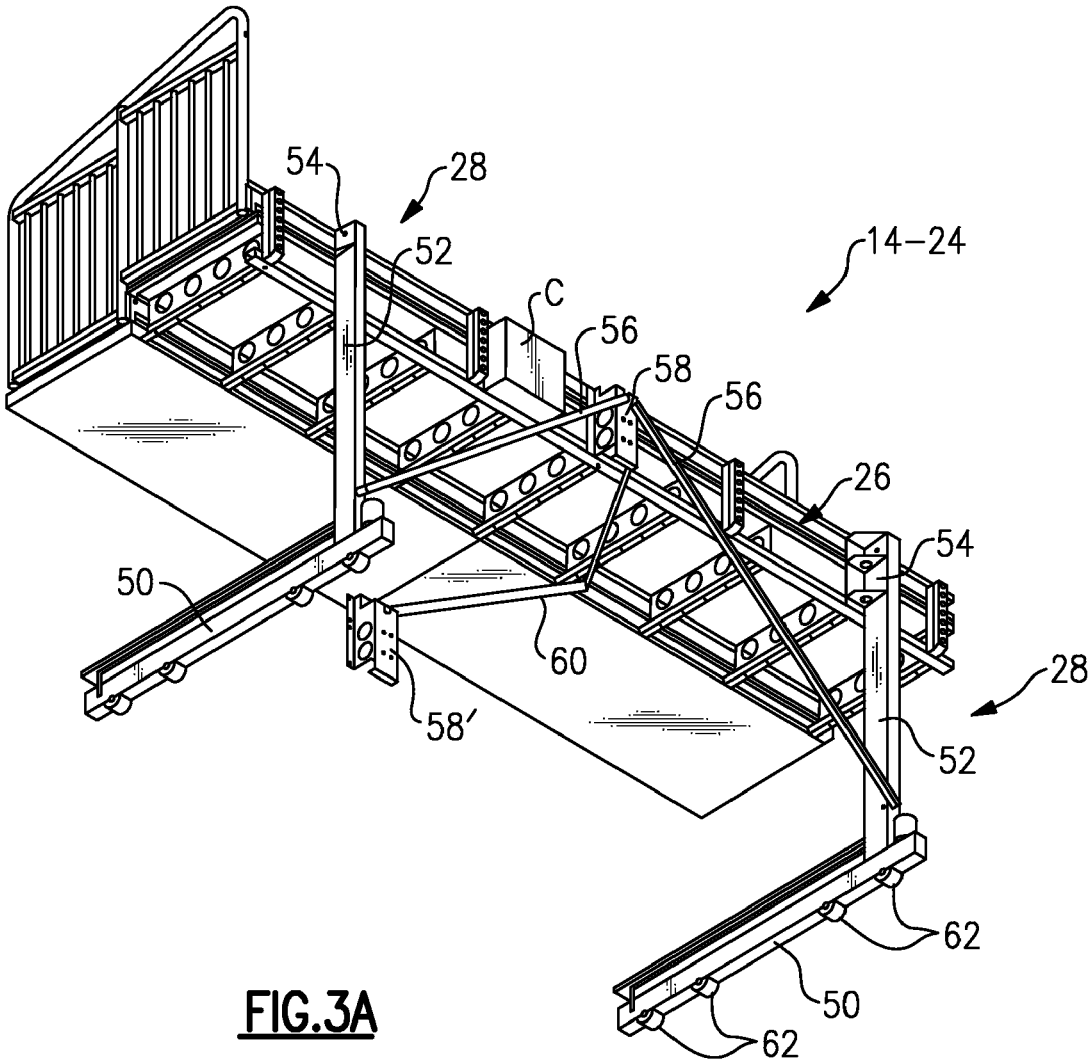
FIG. 3A is a perspective generally bottom view of a single riser assembly.

Referring to FIG. 3A, each telescopic leg assembly 28 includes a horizontal leg 50 and a vertical leg 52. It should be understood that although only a single leg assembly will be described, it should be understood that each leg assembly on each dual elevated riser assemblies 14-24 is generally alike. Notably, each riser assembly 14-24 telescopes under the next higher riser assembly 14-24.

Each vertical leg 52 is attached to the rear of the dual deck surface 26 through a bracket 54. The vertical leg 52 is preferably manufactured of square tubing, however, other shapes may likewise be usable with the present invention.

A set of rear cross members 56 are connected to the vertical leg 52 at their lower end and to the dual deck surface 26 at their upper end through a central bracket 58. The rear cross members 56 further stabilizes each riser assembly 14-24. The central bracket 58 is connected to another central bracket 58' on the next riser assembly 14-24 through an articulatable linkage 60 which articulates in response to telescopic movement of the riser assemblies 14-24. The linkage 60 preferably provides a passage for the communication of power cables, electronic control and the like.

The horizontal leg 50 is supported on wheels 62. Preferably, four wheels 62 are mounted within each of the horizontal legs 50 to allow each riser assemblies 14-24 to readily travel over a floor surface.

Figure 3B:
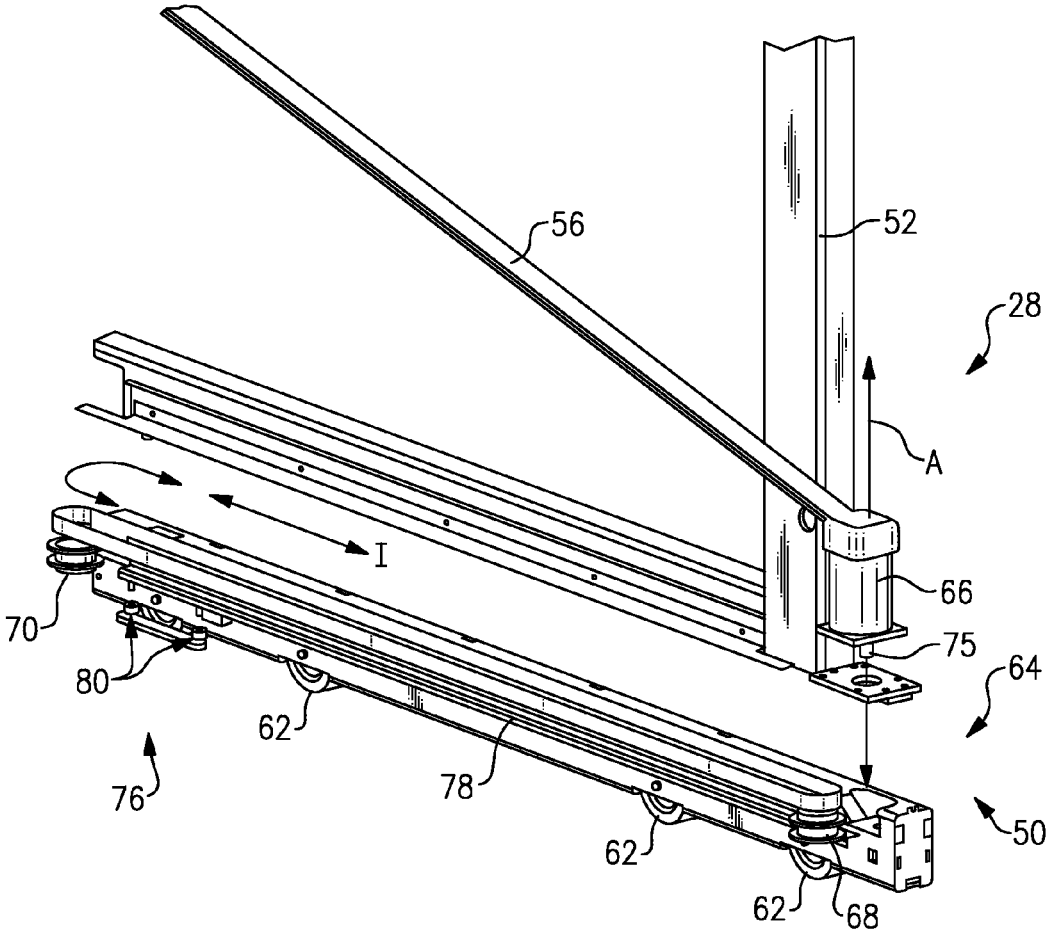
FIG. 3B is an expanded partially exploded view of a horizontal leg of the telescopic leg assembly of the riser assembly.
Figure 3C:
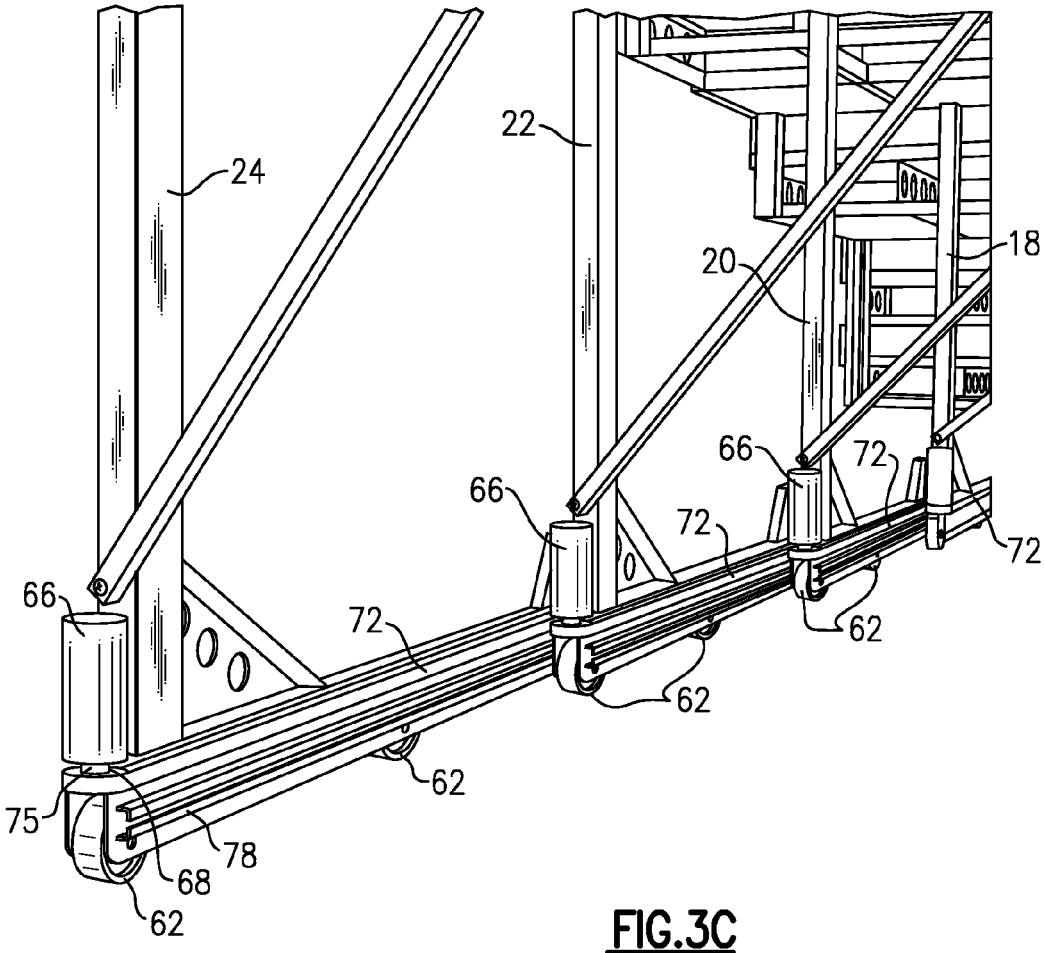
FIG. 3C is a perspective generally underside view of the non-permanent seating system in a deployed position illustrating a belt drive system and the interaction of a timing belt between each of the multiple of riser assemblies.

Referring to FIG. 3B, each horizontal leg 50 of each leg assembly 28 supports a toothed belt drive system 64. The belt drive system 64 includes an electric motor 66, an inner pulley 68, an outer pulley 70 and a toothed timing belt 72 therebetween. The toothed belt drive system 64 provides the interface between each adjacent riser assembly 14-24 (FIG. 3C) and the motive force to extend and retract the riser system 12 in a telescopic manner. The toothed timing belt 72 is continuous in this example. That is, the toothed timing belt 72 is a loop lacking a defined end.

The electric motor 66 is mounted directly aft of the vertical leg 52 in a readily accessible location. Notably, the power cable 67 from the electric motor 66 is preferably threaded through the associated rear cross members 56 to communicate with the central bracket 58 and a controller C preferably on the uppermost riser assembly 24.

Figure 3D:
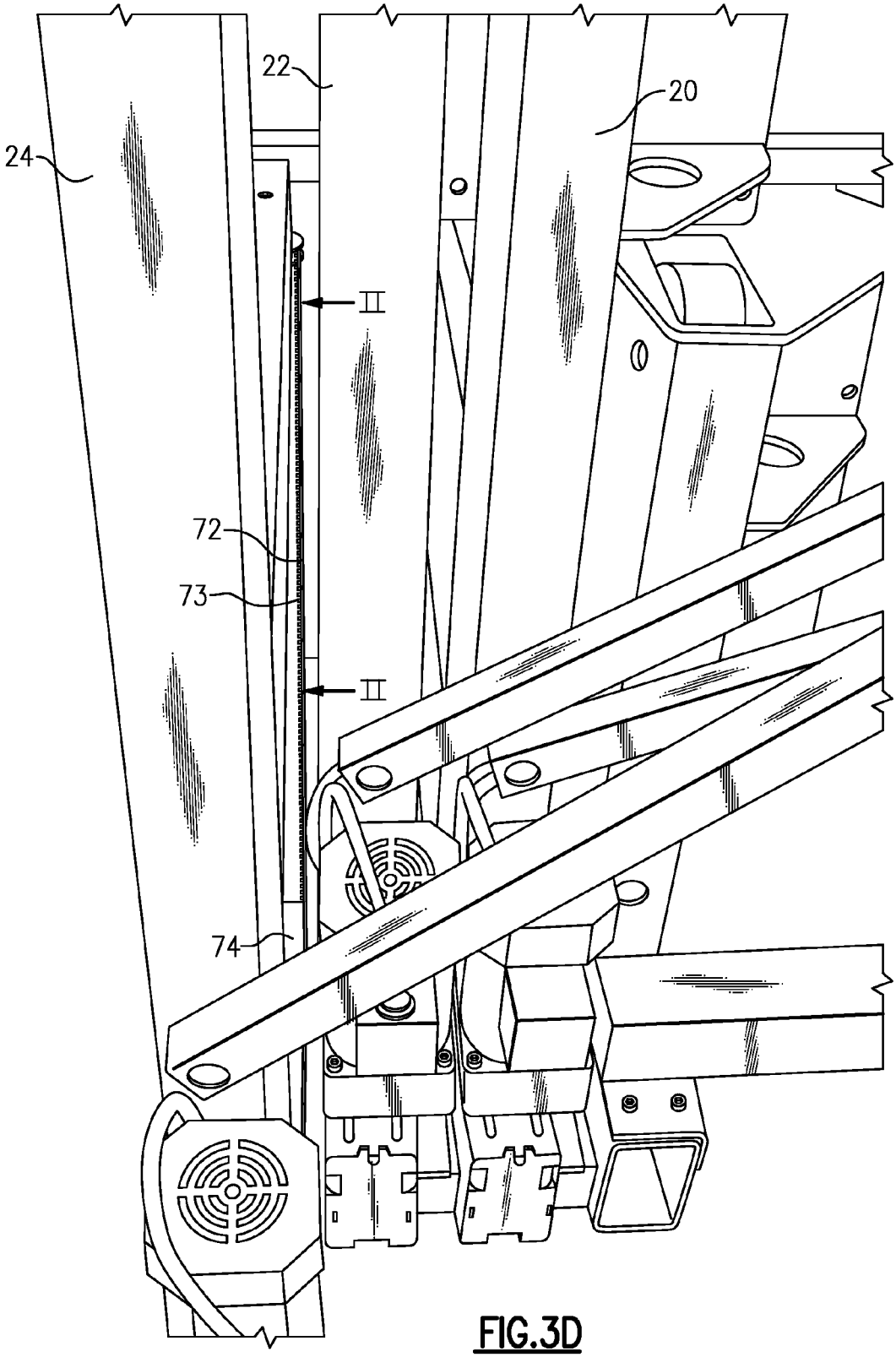
FIG. 3D is a perspective generally rear view of a multiple of the telescopic seat riser systems illustrating the tooth timing belt location.

The inner pulley 68 and the outer pulley 70 include a toothed surface to engage the toothed belt with a minimum of slippage. The example toothed surface includes a plurality of vertically extending teeth 73. The inner pulley 68 and the outer pulley 70 rotate about respective axes generally parallel to the vertical leg 52. The electric motor 66 includes a shaft 75 directly connected to the inner pulley 68. The shaft 75 rotates about an axis A that is perpendicular to the direction of movement I of the toothed timing belt 72. The direction of movement I establishes a belt plane associated with the toothed timing belt 72. The toothed timing belt 72 preferably faces away from, but is engaged with, each adjacent horizontal leg 50 of the next inner riser assembly 14-24 (FIG. 3D). That is, the toothed timing belt 72 of the belt drive system 64 on the horizontal leg 50 of the outermost riser assembly 24 faces inward toward its own horizontal leg in direction II. The belt 72, however, is engaged with the horizontal leg 50 of the next inner riser assembly 22 through a belt clamp 74.

Figure 3E:
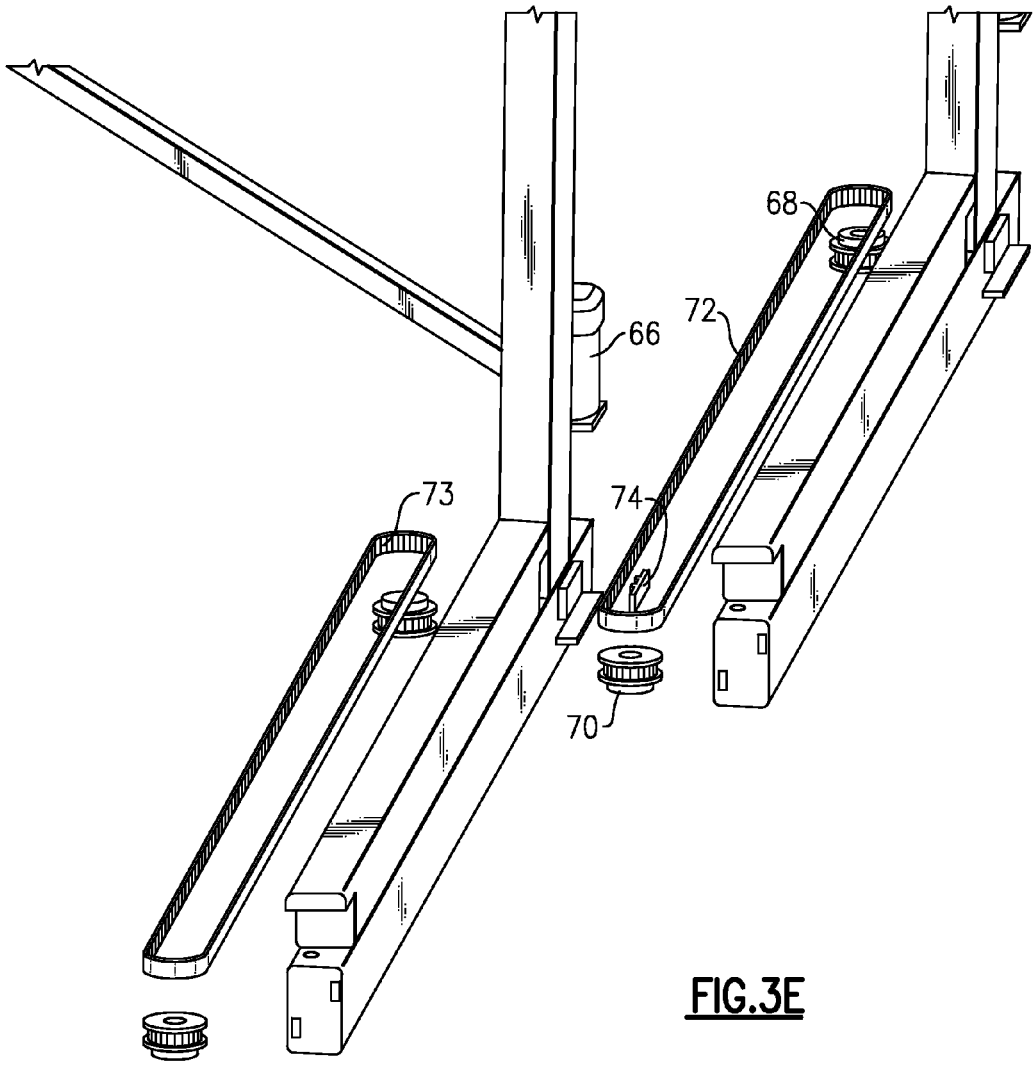
FIG. 3E is an exploded view of the tooth belt drive system.
Figure 3F:
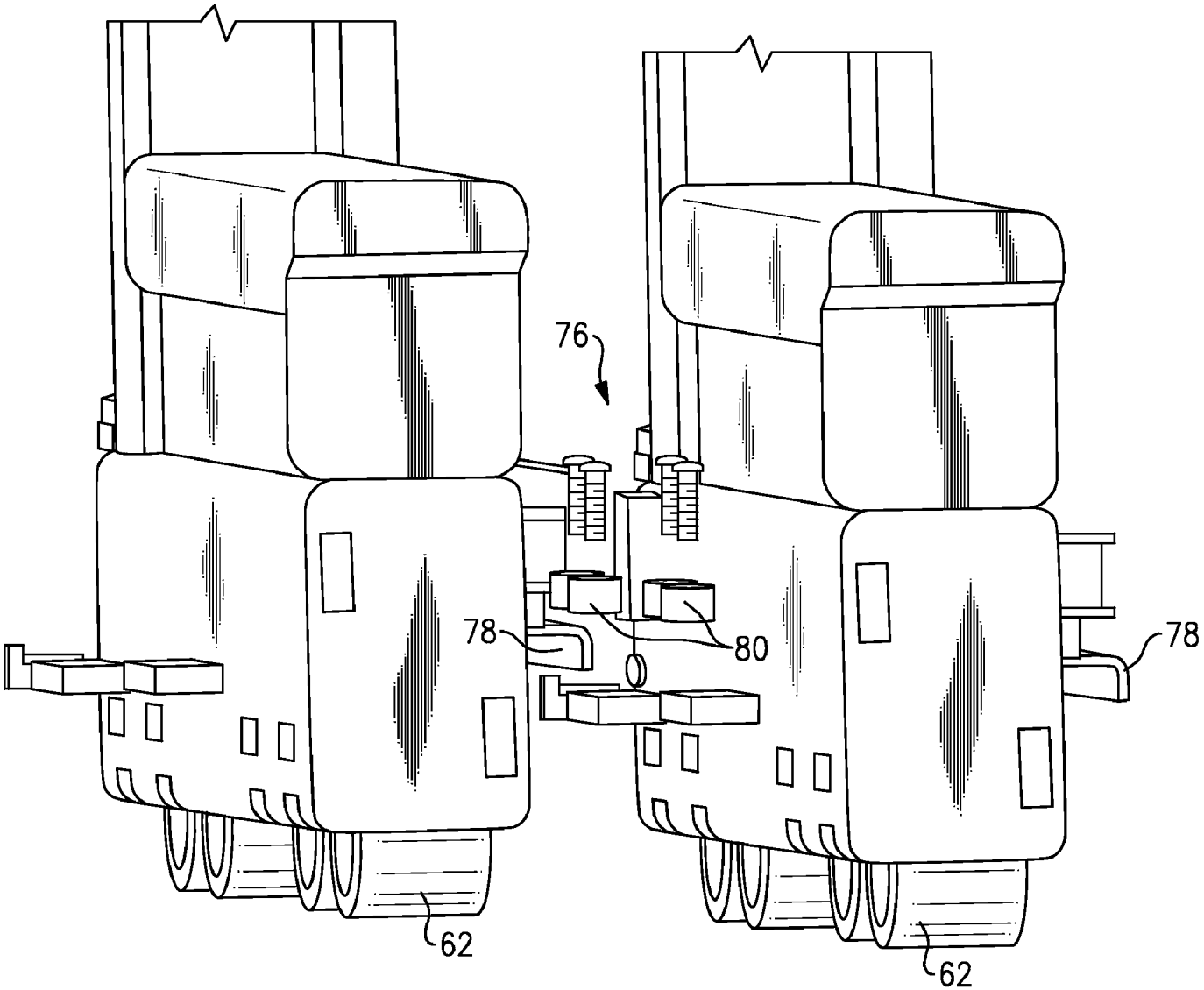
FIG. 3F is an exploded view of a guide roller assembly which movably links the riser assembly with the next adjacent riser assembly.

The toothed timing belt 72 engages the belt clamp 74 located on an outer surface of the adjacent next inner riser assembly 14-24 (FIG. 3E). Preferably, the belt clamp 74 is located adjacent the intersection of the horizontal leg 50 and the vertical leg 52 and includes a toothed surface which matches the toothed timing belt 72 for engagement therewith. The belt clamp 74 provides the engagement between the toothed timing belt 72 of the outer next inner riser assembly 14-24 with the next inner riser assembly 14-24 such that rotation of the toothed timing belt 72 drives the next inner riser assembly 14-24 relative the associated outer riser assembly 14-24.

Figure 3G:
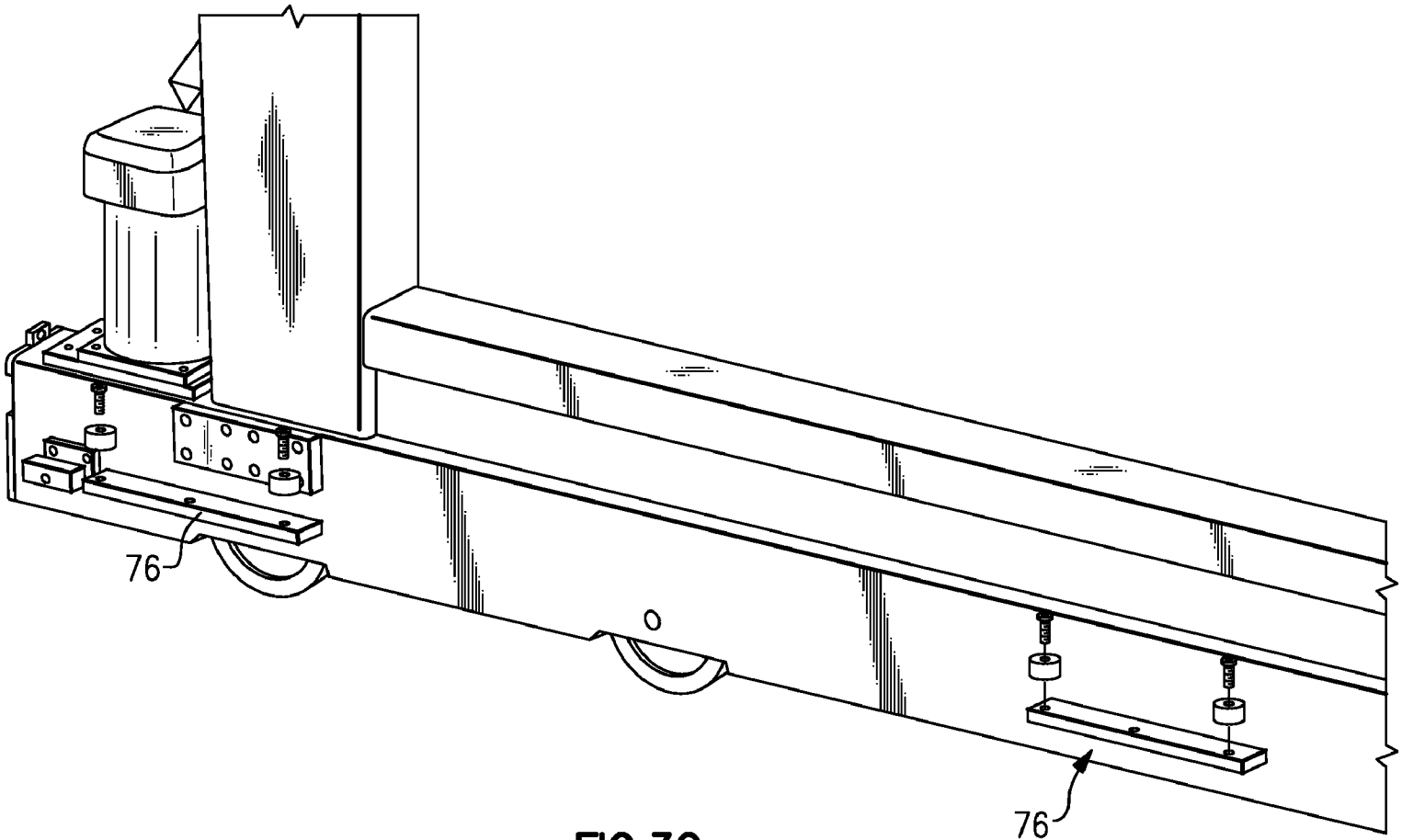
FIG. 3G is a perspective inner view of the locations of the guide assemblies for engagement with a track on an adjacent riser assembly.

Referring to FIG. 3B, a guide assembly 76 along the length of the horizontal leg 50 further guides the inner riser assembly 14-24 relative the associated outer riser assembly 14-24. Preferably, a track 78 and guider roller assembly 80 (FIG. 3G) provides an effective low friction interface between one inner riser assembly 14-24 and the next associated outer riser assembly 14-24. It should be understood that various guide assemblies 76 may be utilized with the present invention.

Figure 2D:
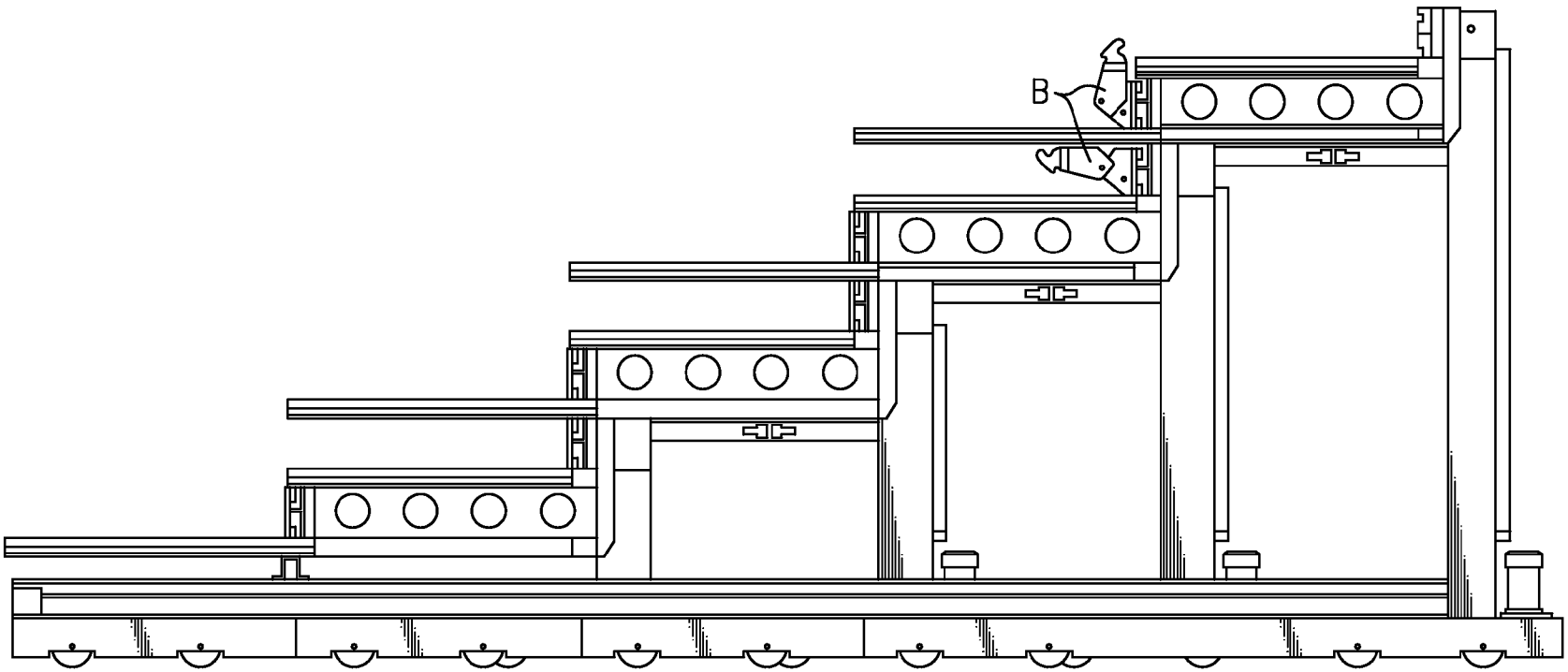
FIG. 2D is a side view of a section of a non-permanent seating system in a half-deployed position in which only half the seating capacity of each riser assembly is utilized but each seating row provides twice the rise.
Figure 2E:
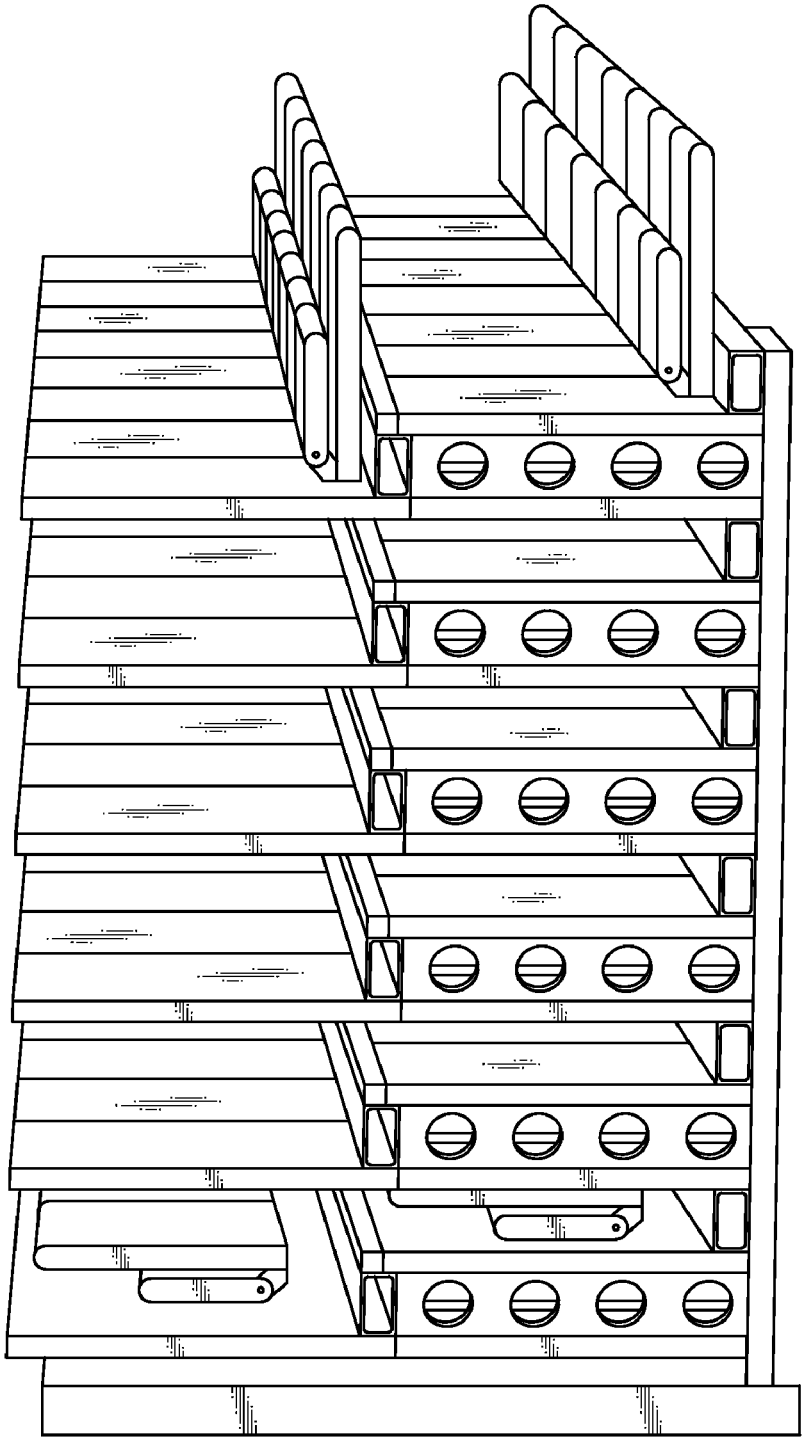
FIG. 2E is a perspective view of the non-permanent seating system in a stored position.
Figures 1, 2F:
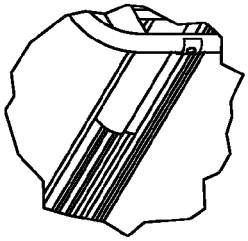
FIG. 2F is a perspective view of the non-permanent seating system illustrating one arrangement of rails and stair blocks therefore.
Figures 2, 2F:
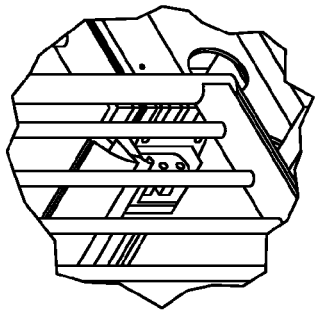
Figure 2F:
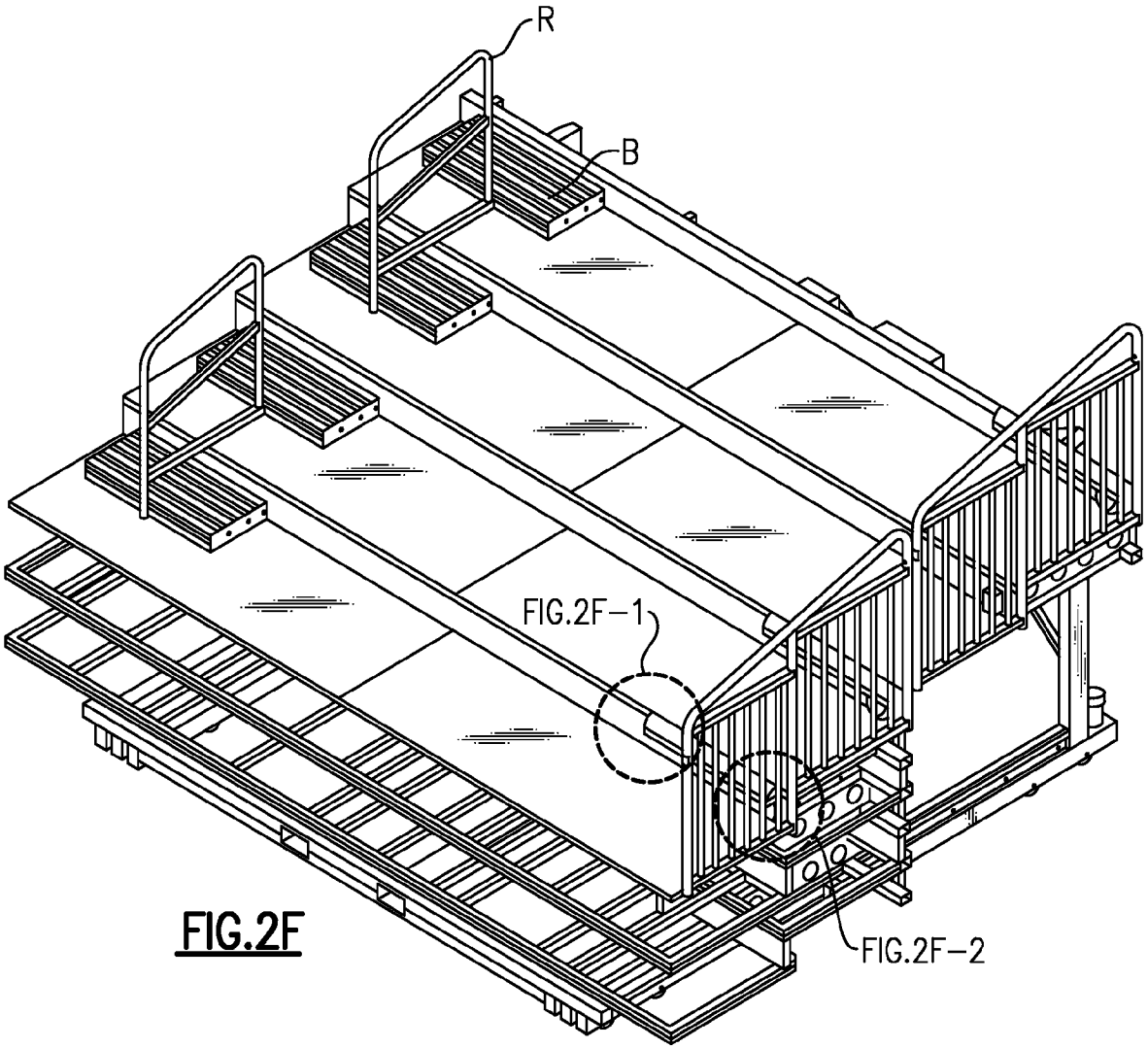
Figures 3H, 4:
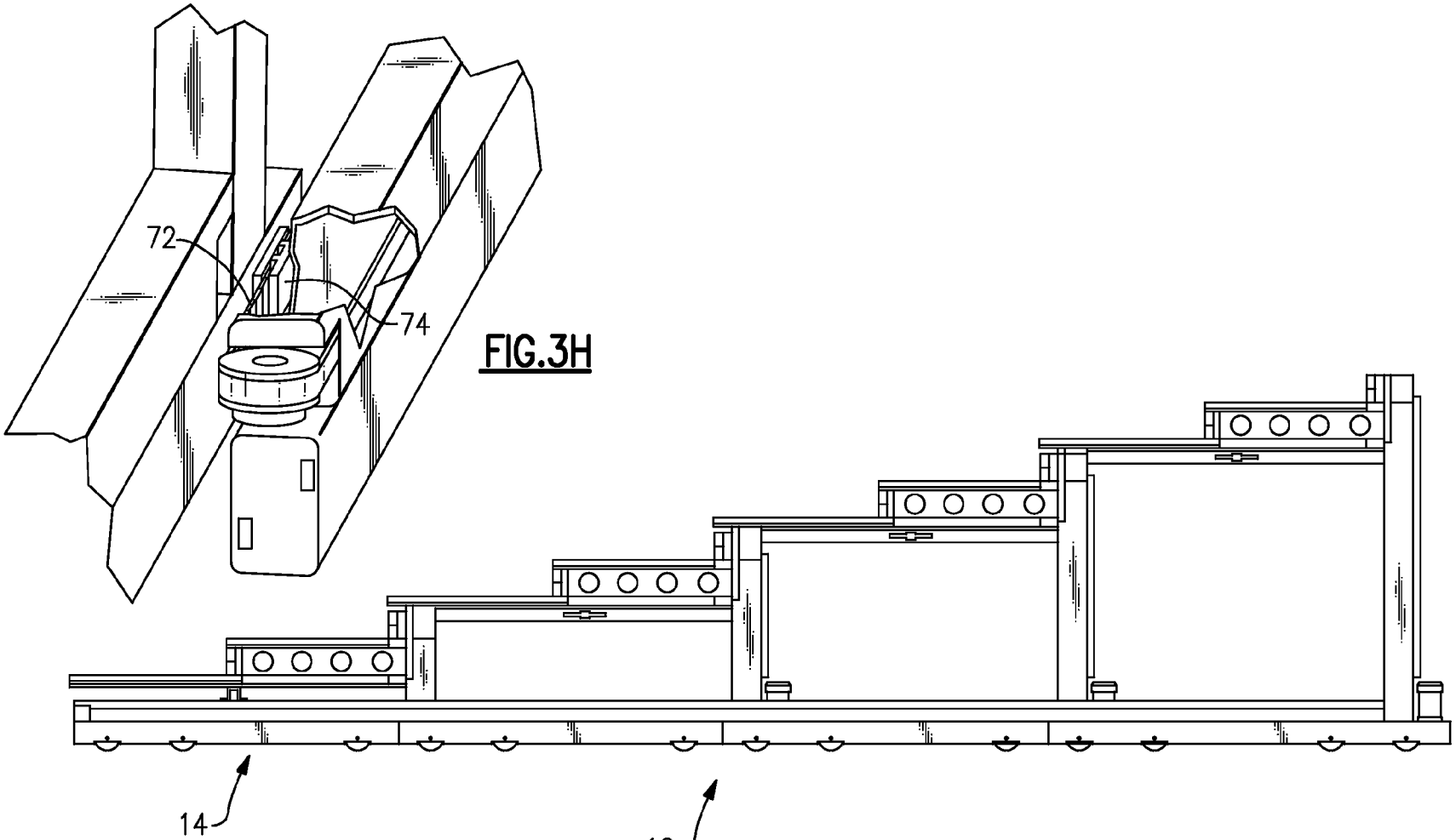
FIG. 3H is a view of the tooth belt drive system in an assembled position.
FIG. 4 is a side view of a section of a non-permanent seating system in a fully deployed position.

In operation, the pair of each electric motors 66 on each riser assembly 14-24 are driven simultaneously by the controller C to fully extend the seating riser system 12 from the storage position (FIG. 2E). The controller C provides for programmed stops of each riser assembly 14-24 such that the telescopic seating system 10 may be readily deployed to the fully extended position (FIGS. 1 and 4) or to the half-deployed position (FIG. 2D). The half-deployed position utilizes only half the seating capacity of each riser assembly 14-24 but provides twice the rise between each seating row to thereby accommodate particular venues. The controller C also communicates with each motor 66 such that the telescopic seating system 10 can be assured of straight tracking through torque sensing. Furthermore, the belt drive system 64 assures coordinated deployment as the toothed timing belt 72 minimizes the likelihood of slippage.

It will be appreciated that seating system is a load bearing structure intended to hold many people and equipment, such as portable seating, above a floor surface. Therefore, the telescopic seating system is suitably constructed. For instance, the structural members of the telescopic seating system preferably are constructed of thin wall tubing, straight bar stock, right angle bar stock, and plate of suitable materials, for instance, steel, alloy, aluminum, wood or high strength plastics. Components may be joined in any number of conventional manners, such as by welding, gluing or with suitable fasteners. Wheels are preferably of the solid caster type. It will be appreciated that in reference to the wheels, such wheels may be constructed of any device that provides rolling or other relative movement, such as sliding, between respective track surfaces.

It should be understood that relative positional terms such as "forward," "aft," "upper," "lower," "above," "below," and the like are with reference to the normal operational attitude of the system and should not be considered otherwise limiting.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A telescopic seating riser assembly comprising:

a dual deck surface;

a telescopic leg assembly attached to said dual deck surface; and a toothed belt drive system mounted to said telescopic leg assembly and including an electric motor that rotates a shaft about an axis to drive a toothed timing belt in a direction transverse the axis, wherein said toothed timing belt is a continuous belt that engages a first and a second pulley mounted to a horizontal leg of said telescopic leg assembly.

2. The assembly as recited in claim 1, wherein the axis is generally parallel to a vertical leg of said telescopic leg assembly.

3. The assembly as recited in claim 1, wherein a toothed surface of said toothed timing belt is substantially parallel to the axis.

4. The assembly as recited in claim 1, wherein said dual deck surface includes a lower deck surface and an upper deck surface that establish respective deck planes, wherein the toothed belt drive system is configured to drive a toothed timing belt within a belt plane substantially parallel to the deck planes.

5. The assembly as recited in claim 1, wherein said dual deck surface includes a sandwich structure to define a deck panel manufactured of an upper deck skin, a lower deck skin and a core sandwiched therebetween.

6. The assembly as recited in claim 5, wherein said core includes an end-grained balsawood.

7. The assembly as recited in claim 1, wherein said dual deck surface includes an access track beam arranged in a vertical relationship between a lower deck surface and an upper deck surface.

8. The assembly as recited in claim 7, further comprising longitudinal slots located within said access track beam.

9. The assembly as recited in claim 1, wherein the toothed belt drive system comprise a toothed timing belt that is rotatable within a first plane, and the telescopic leg assembly is configured to telescope in a first direction parallel to the first plane.

10. The assembly as recited in claim 1, wherein the toothed belt drive system comprises a pulley that rotates about an axes parallel to a vertical leg of the telescopic leg assembly.

11. The assembly as recited in claim 1, wherein the toothed belt drive system comprises a motor that is secured adjacent a vertically extending leg of the telescopic leg assembly.

12. The assembly as recited in claim 1, wherein said electric motor is mounted to said telescopic leg assembly such that said electric motor moves together with said telescopic leg assembly as said telescopic leg assembly is telescoped.

13. A telescopic seating system comprising:

an inner riser assembly;

an outer riser assembly;

a dual deck surface mounted to said inner riser assembly and said outer riser assembly; and a toothed belt drive system engaged with said inner riser assembly and said outer riser assembly to telescope said inner riser assembly relative said outer riser assembly, wherein said toothed belt drive system is mounted to said outer riser assembly, and said toothed belt drive system includes a toothed timing belt having vertically aligned teeth facing a horizontal leg of said outer riser assembly.

14. The system as recited in claim 13, wherein said dual deck surface includes a sandwich structure to define an upper deck panel and a lower deck panel each manufactured of an upper deck skin, a lower deck skin and a core sandwiched therebetween.

15. The system as recited claim 13, wherein said inner riser assembly slidably engages said outer riser assembly.

16. The system as recited in claim 13, further comprising a belt clamp located on an outer surface of a horizontal leg of said inner riser assembly, said belt clamp configured to engage with said toothed belt.

17. The assembly as recited in claim 13, wherein the toothed belt drive system comprises a belt configured to rotate within a plane that is parallel to direction that the inner riser telescopes relative to the outer riser assembly.

18. The system as recited in claim 13, wherein a motor of said toothed belt drive system is configured to move together with at least one of said inner riser assembly or said outer riser assembly.

* * * * *